US007823223B2

(12) United States Patent
Ehmsen

(10) Patent No.: US 7,823,223 B2
(45) Date of Patent: Nov. 2, 2010

(54) UNDERPANTS

(75) Inventor: Lena Ehmsen, Hilversum (NL)

(73) Assignee: Coloplast A/S, Humlebaek (DK)

( * ) Notice: Subject to any disclaimer, the term of this patent is extended or adjusted under 35 U.S.C. 154(b) by 0 days.

(21) Appl. No.: 10/588,655

(22) PCT Filed: Feb. 4, 2005

(86) PCT No.: PCT/DK2005/000079

§ 371 (c)(1),
(2), (4) Date: Jun. 11, 2007

(87) PCT Pub. No.: WO2005/074731

PCT Pub. Date: Aug. 18, 2005

(65) Prior Publication Data

US 2007/0220659 A1 Sep. 27, 2007

(30) Foreign Application Priority Data

Feb. 6, 2004 (DK) ..... 2004 00185

(51) Int. Cl.
*A41B 9/04* (2006.01)
*A41B 9/02* (2006.01)

(52) U.S. Cl. ..... 2/408; 2/406; 2/400; 2/403

(58) Field of Classification Search ..... 2/400–408, 2/227, 228, 238, 67, 114
See application file for complete search history.

(56) References Cited

U.S. PATENT DOCUMENTS

| | | | | |
|---|---|---|---|---|
| 2,396,599 | A * | 3/1946 | O'Brien | 2/408 |
| 4,145,763 | A * | 3/1979 | Abrams et al. | 2/403 |
| 4,675,918 | A * | 6/1987 | O'Brien | 2/402 |
| 4,835,795 | A * | 6/1989 | Lonon | 2/408 |
| 6,752,797 | B2 | 6/2004 | Oba | |
| 6,964,065 | B2 * | 11/2005 | Stevenson | 2/400 |
| 2003/0158535 | A1 | 8/2003 | Dahlgren | |

FOREIGN PATENT DOCUMENTS

| | | |
|---|---|---|
| DE | 3839010 | 5/1990 |
| DE | 41 29 722 A1 | 3/1993 |
| EP | 1 133 966 | 9/2001 |
| WO | WO 99/23904 | 5/1999 |
| WO | WO 01/43672 | 6/2001 |

* cited by examiner

*Primary Examiner*—Gloria Hale
(74) *Attorney, Agent, or Firm*—Coloplast Corp.; Daniel G. Chapik; Nicholas R. Baumann

(57) ABSTRACT

A pair of underpants including a front part, a back part, a crotch part and two leg holes delimited by the parts. The underpants further include a releasable connection for connecting the crotch part to the front part and allowing an opening to be formed in the crotch area. The releasable connection extends from one leg hole to the other and includes two parts, one overlapping the other in the closed condition. The ends of a part of the releasable connection are provided with a flexible protection element.

19 Claims, 6 Drawing Sheets

UNDERPANTS

This is a nationalization of PCT/DK2005/000079 filed 4 Feb. 2005 and published in English.

This invention relates to a pair of underpants comprising a front part, a back part, a crotch part and two leg holes delimited by the parts, and releasable connecting means for connecting the crotch part to the front part, said releasable connecting means extending from one leg hole to the other and allowing an opening including the leg holes to be formed in the crotch area.

The purpose of providing an opening in the crotch area is for the wearer to be able to go to the toilet without having to take the underwear off. This has been proposed for example for a body stocking, as such a garment covers the whole torso it is very troublesome to remove the whole garment when going to the bathroom.

An opening in the crotch area is especially desirable for patients with a stoma in cases where the ostomy collection bag is placed outside the underwear.

Underwear with a releasable connecting means in the crotch area is well known. These releasable connecting means are usually Velcro-bands, buttons and corresponding buttonholes, hooks and eyes, etc. These structures are often placed on a band, often made of a polymer material, and when the band is cut to fit in the underpants the edges may be rough and can cause discomfort and irritation in the groin area.

It is an object of the invention to prevent irritation and discomfort originating from rough edges on releasable connecting means on underpants with an opening thus making the underwear more comfortable for the wearer.

It is a further object of the invention to make it easier for the wearer to open an opening on a pair of underpants.

SUMMARY OF THE INVENTION

The pair of underpants according to the invention comprises a front part, a back part, a crotch part and two leg holes, and releasable connecting means for connecting the crotch part to the front part and allowing an opening to be formed in the crotch area, said releasable connecting means extending from one leg hole to the other and comprising two parts one overlapping the other in the closed condition characterized in that ends of one of the parts of said releasable connecting means are provided with flexible protection means.

The invention is based on the discovery that by folding the protection means provided on the ends of one part of the releasable connecting means around the ends of the releasable connecting means of the other part, the discomfort caused by said ends is minimized thereby making the underpants more comfortable.

The flexible protection means are preferably placed on the outer overlapping part of the releasable connecting means but may also be provided on the inner part of the releasable connecting means.

When the flexible protection means are placed on the outer overlapping part of the releasable connecting means, the protection means are secured between the body of the user and the underpants. When the flexible protection means are placed on the inner part of the releasable connection means the protection means are secured to the outer side of the underwear by additional fastening means.

In a preferred embodiment the protection means are in the form of ribbons, made from a soft material. Each ribbon preferably has a sufficient width to cover the edge to be protected.

The ribbons can be made of cotton, nylon or any other material suitable for straps or tapes being relatively unstretchable and having a soft feel.

The length of the ribbons can vary from 15 to 120 mm, preferably being of a length sufficient to keep the ribbons in place when tucked between the underpants and the body of the wearer.

In a further preferred embodiment of the invention the ribbon is in the form of a loop, making it easier for persons with poor dexterity to disengage the interconnected releasable connecting means. The loop is preferably of a length of 95 to about 160 mm enabling the loop to hold diameters from around 30 mm to around 50 mm, a size large enough for a person to be able to place one or two fingers in the loop and thereby use it to pull the connecting means apart.

For persons with poor dexterity the flexible protection means is preferably placed on the inner part of the releasable connecting means, in order for the protection means to fold out over the edges of the connecting means and be fastened on the outside of the underpants.

DETAILED DESCRIPTION

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
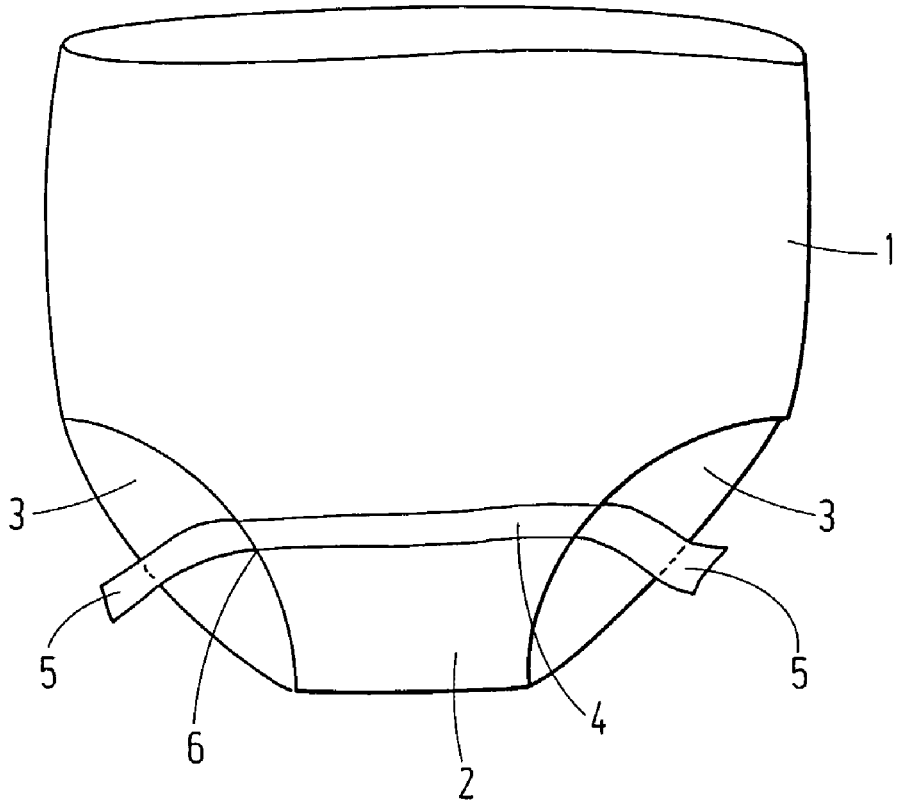
FIG. 1 illustrates a front view of a preferred embodiment of a pair of underpants according to the invention.

FIG. 1 illustrates a pair of underpants with a front part 1, a crotch part 2, two leg holes 3, releasable connecting means 4 one overlapping the other and two flexible protection means 5 attached to the ends 6 of the releasable connecting means 4 in the leg holes 3 of the underpants.

Figure 2:
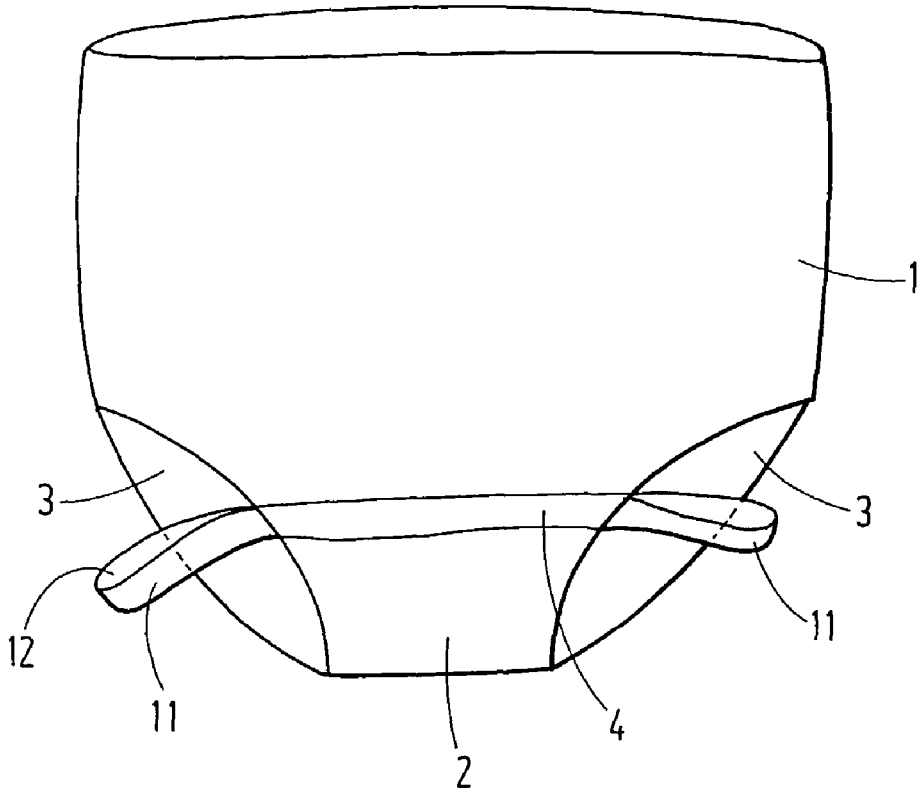
FIG. 2 illustrates a front view of another preferred embodiment of a pair of underpants according to the invention.
Figure 3:
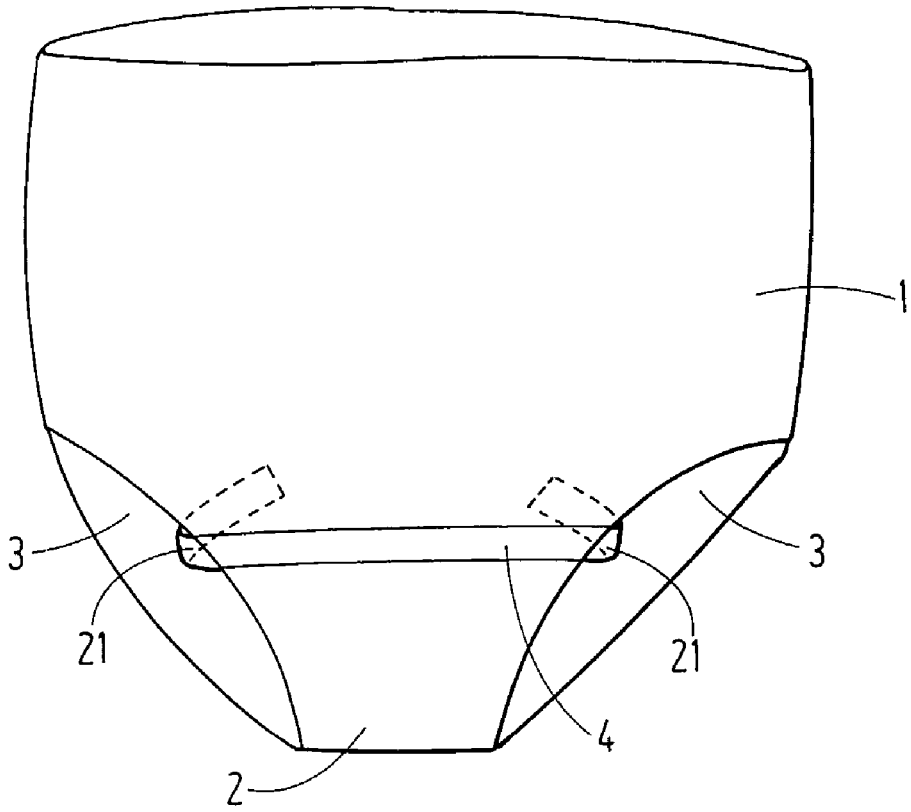
FIG. 3 illustrates a front view of a further preferred embodiment of a pair of underpants according to the invention

In FIGS. 2 and 3 the various parts of the pair of underpants are designated with the same reference numbers as in FIG. 1.

FIG. 2 illustrates another embodiment of the invention comprising two flexible protection means 11 which are in the form of loops. The loops are large enough for accommodating a finger.

FIG. 3 illustrates a further embodiment of the invention comprising two flexible protection means 21 which are folded through the leg holes 3 to the inside of the underpants. When the underpants are in use the flexible protection means 21 are placed between the underpants and the body of the user where the pressure between these two keep the flexible protection means 21 in place.

Figure 4:
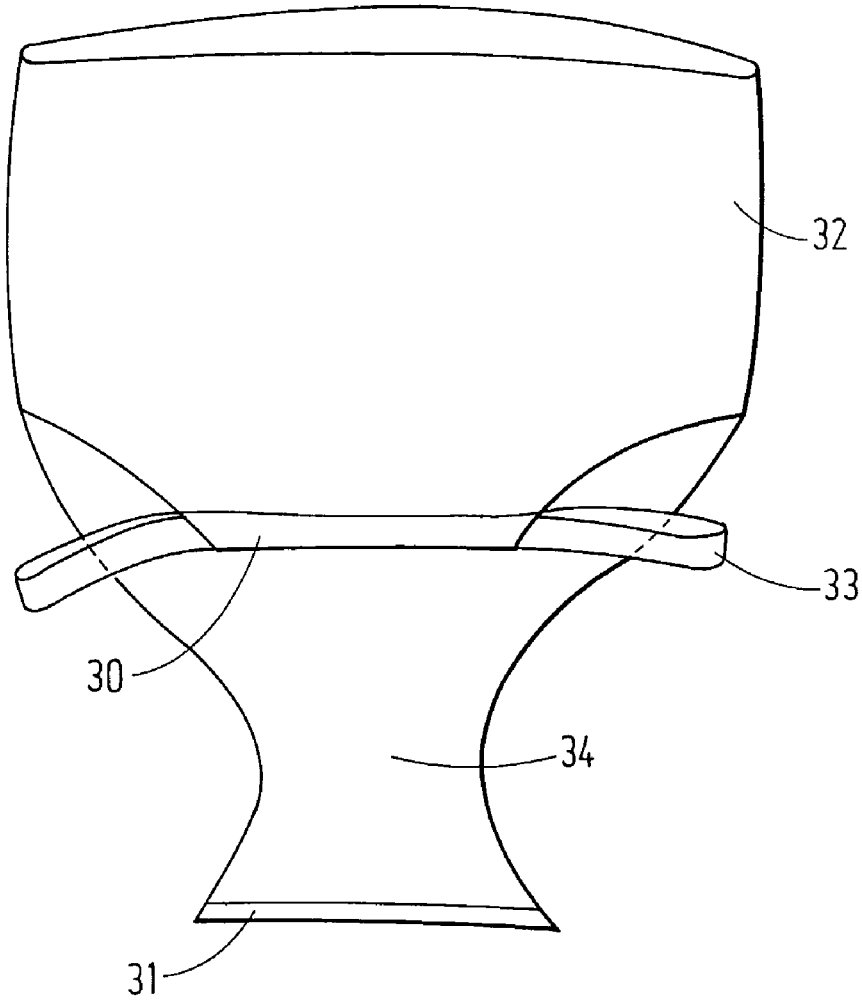
FIG. 4 illustrates a front view of yet another preferred embodiment of a pair of underpants in open condition according to the invention.

FIG. 4 illustrates an embodiment corresponding to FIG. 2, wherein the flexible protection means are located on the front part in an open condition, i.e. where the releasable connecting means 30, 31 are disengaged. A first releasable connecting means 31 is placed on the crotch part 34 of the underpants and a corresponding releasable connecting means 30 is placed on the front part 32 of the underpants. A flexible protection means 33 in the form of a loop is attached to the underwear around the ends of the releasable connecting means 30.

Figure 5:
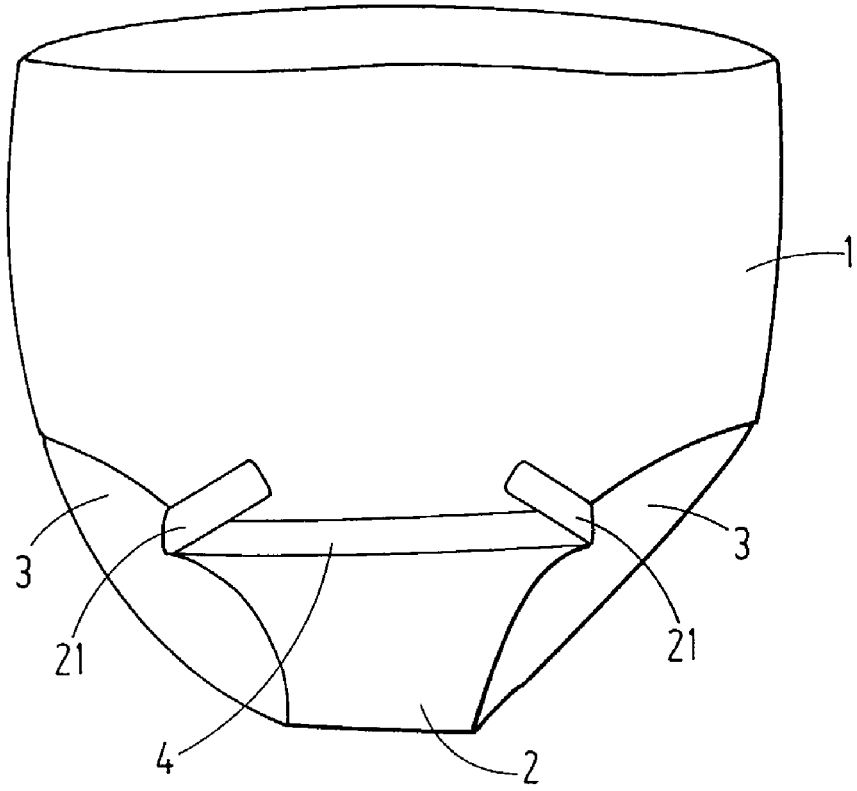
FIG. 5 illustrates a front view of a further preferred embodiment of a pair of underpants according to the invention.

FIG. 5 illustrates an embodiment of the invention corresponding to FIG. 3, wherein the flexible protection means 21 are folded from the inner part of the releasable connecting means to the outside of the underpants.

The flexible protection means can be fastened to the underpants by additional fastening means, e.g. buttons and corresponding button holes, Velcro®, hooks and eyes, snap fastener, etc. The additional protection means can be placed on the underpants, e.g. on the releasable connecting means or on the front part or the crotch part.

Figure 6:
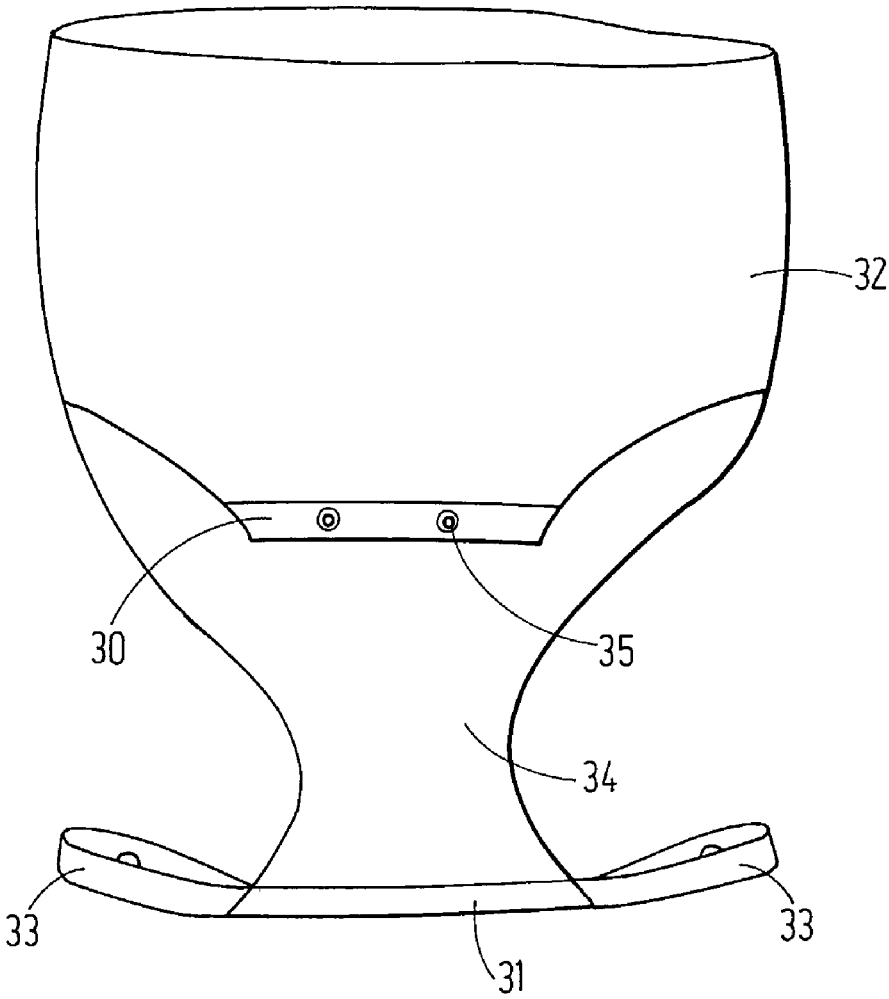
FIG. 6 illustrates another preferred embodiment of a pair of underpants in open condition according to the invention.

FIG. 6 illustrates a further embodiment of the invention in an open condition. A first releasable connecting means 30 is placed on the crotch part 32 while a corresponding releasable connecting means 31 is located on the front part 34 of the underpants. A flexible protection means 33 is located on the ends of the releasable connecting means 31 on the crotch part 34. Two parts of a snap fastener 35 are located on the front part 32 on the opposite surface compared to the releasable connecting means 30, and corresponding part of a snap fastener on each flexible protection means 31 on the crotch part 34, for securing the flexible protection means 33 to the underpants.

If desired the crotch part and the back part may be made of in one piece, or the front part and the back part may be made in one piece. Furthermore, if desired all the parts can be made in one piece.

The underpants can be made of any traditional material for making underpants, e.g. cotton, silk or it can be made of material particularly suitable for use in support garments e.g. for patients with a stoma.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A pair of underpants comprising a front part, a back part, a crotch part and two leg holes delimited by the parts, a releasable connection having two parts that join in an overlapped region when in a closed condition to connect the crotch part to the front part and form an edge portion of each of the leg holes and that are separated from one another when in an open condition to allow an opening to be formed in the crotch area, with one of the two parts of the releasable connection connected to the front part of the underpants and extending from one leg hole to the other and including a flexible protection element attached to an end of the one part of the releasable connection that is connected to the front part of the underpants so that the flexible protection element extends from an edge portion of at least one of the leg holes and is so configured to wrap over and at least partly cover the edge portion of the at least one of the leg holes when the releasable connection in the closed condition.

2. The pair of underpants according to claim 1, wherein the two leg holes are part of the opening formed in the crotch area in the open condition.

3. The pair of underpants according to claim 1, wherein the flexible protection element is attached to the outer overlapping part of the releasable connection and is adapted to fold around the edge portion of the at least one of the leg holes formed by the releasable connection when in the closed condition.

4. The pair of underpants according to claim 1, wherein the flexible protection element is made of one of cotton and nylon.

5. The pair of underpants according to claim 1, wherein the flexible protection element is in the form of one or more ribbons that cover the overlapped region in the closed condition.

6. The pair of underpants according to claim 5 wherein the ribbons have a length of about 15 mm to about 120 mm.

7. The pair of underpants according to claim 1, wherein the flexible protection element is an elongated loop of material.

8. The pair of underpants according to claim 7 wherein the loop has a length of about 95 mm to about 160 mm enabling the loop to hold diameters from about 30 mm to about 50 mm.

9. The pair of underpants according to claim 1, wherein the flexible protection element includes two separate sections with a first section attached to a first end of the releasable connection and configured to wrap around the edge portion of a first of the two leg holes formed by the releasable connection in the closed condition and a second section attached to a second end of the releasable connection and configured to wrap around the edge portion of a second of the two leg holes formed by the releasable connection in the closed condition.

10. The pair of underpants according to claim 1, wherein the flexible protection element is attached to the inner overlapping part of the releasable connection and is adapted to fold around the edge portion of the at least one of the leg holes formed by the releasable connection when in the closed condition.

11. The pair of underpants according to claim 10, wherein a portion of the flexible protection element is secured to an outer side of said underpants by a fastening component when in the closed condition.

12. A pair of underpants comprising a front part, a back part, a crotch part and two leg holes delimited by the parts, a releasable connection having two parts that join when in a closed condition to connect the crotch part to the front part and form an edge portion of each of the leg holes and that are separated from one another when in an open condition to allow an opening to be formed in the crotch area, said releasable connection extending from one leg hole to the other, and a first flexible protection element extending from a first end of said releasable connection and a second flexible protection element extending from a second end of said releasable connection, the first and second flexible protection elements foldable to an inside of the underpants and separately foldable to an outside of the underpants, and when folded adapted to wrap around and at least partly cover the edge portion of at least one of the leg holes to thereby increase comfort for a wearer of the underpants.

13. The pair of underpants according to claim 12, wherein the two leg holes are part of the opening formed in the crotch area in the open condition.

14. The pair of underpants according to claim 12, wherein said two parts overlap in said closed condition as an outer overlapping part and an inner overlapping part.

15. The pair of underpants according to claim 14, wherein the flexible protection element is attached to the outer overlapping part.

16. The pair of underpants according to claim 14, wherein the flexible protection element is attached to the inner overlapping part in the closed condition.

17. The pair of underpants according to claim 16, wherein a portion of the flexible protection element is secured to an outer side of said underpants by a fastening component when in the closed condition.

18. The pair of underpants according to claim 12, wherein the flexible protection element is in the form of a narrow elongated strip of a soft material suitable for wearing against the skin.

19. The pair of underpants according to claim 12, wherein one of the two parts of the releasable connection is connected to the front part of the underpants and extends from one leg hole to the other, with the first and second flexible protection elements each extending from an opposed end of the one part of the releasable connection that is connected to the front part of the underpants so that each of the flexible protection elements extend from an edge portion of one of the leg holes and is so configured to wrap over and at least partly cover the edge portion of the leg hole when the releasable connection in the closed condition.

* * * * *